United States Patent [19]

Fuchs

[11] 4,117,978

[45] Oct. 3, 1978

[54] SYSTEM FOR FEEDING SOLUTIONS AND SUSPENSIONS

[75] Inventor: Heribert Fuchs, Vienna, Austria

[73] Assignee: Ruthner Industrieanlagen-Aktiengesellschaft, Vienna, Austria

[21] Appl. No.: 764,561

[22] Filed: Feb. 1, 1977

[30] Foreign Application Priority Data

Jan. 29, 1976 [AT] Austria ..... 621/76

[51] Int. Cl.[2] ..... B05B 15/02

[52] U.S. Cl. ..... 239/112; 239/373; 159/43 A

[58] Field of Search ..... 239/112, 113, 74, 373; 159/43 R, 43 A, 44

[56] References Cited

U.S. PATENT DOCUMENTS

| | | | |
|---|---|---|---|
| 927,881 | 7/1909 | Sala | 239/373 X |
| 1,303,987 | 5/1919 | Sturcke | 239/373 X |
| 2,360,445 | 10/1944 | Quasebarth | 159/43 R |
| 3,859,052 | 1/1975 | Walther | 159/44 X |

*Primary Examiner*—John J. Love

*Attorney, Agent, or Firm*—Imirie, Smiley & Guay

[57] ABSTRACT

A system for feeding solutions and suspensions to nozzles for spraying the solution or suspension into a heated furnace chamber comprises at least one blow case for feeding the solution or suspension to be treated to the nozzle under the displacing action of a compressed displacing gas, means for measuring the flow rate and the instantaneous pressure of the displacing gas and means for supplying a purge gas during non-feeding periods, in order to prevent an ingress of corrosive gases into the pneumatic system.

7 Claims, 5 Drawing Figures

SYSTEM FOR FEEDING SOLUTIONS AND SUSPENSIONS

SUMMARY OF THE INVENTION

Figure 1:
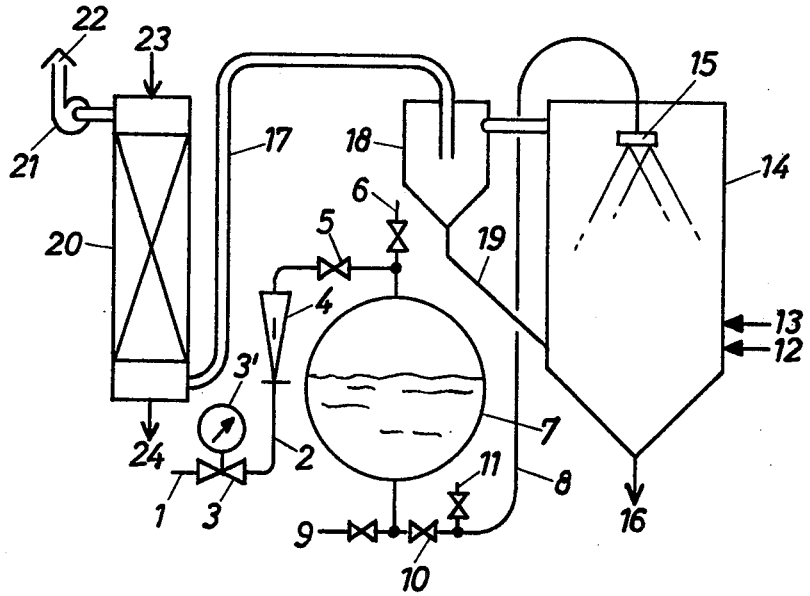

A system for feeding solutions to nozzles for spraying the solution into a furnace chamber comprises at least one blow case for feeding the solution into the furnace chamber under the displacing action of a compressed displacing gas. A plurality of blow cases which operate with a phase displacement are preferably provided. Means are also provided which measure the volumetric flow rate and the instantaneous pressure of the displacing gas.

This invention relates to a system for feeding solutions and suspensions particularly of thermally decomposable metal salts to nozzles for spraying the solution or suspension into a heated furnace chamber.

It is known to treat solutions of halides and free hydrohalic acids, e.g., pickling solutions which contain iron chlorides and hydrochloric acid as main constituents, and generally to form metal oxide by a thermal decomposition of salts and to recover the corresponding acid from the decomposition product of the anion (regeneration of acid by spray roasting).

It will be understood that an efficient recovery of heat is of great importance in view of the high present-day costs of heat and may even be essential for economical operation. For this purpose the hot vapors from the spraying furnace are in most cases mechanically treated for a collection of dust and are then contacted with the solution or suspension which is to be sprayed. In this way the solution or suspension is heated and concentrated and considerable heat is saved. At the same time, fine dust is effectively collected from the exhaust gases from the furnace by a wet treatment. This is of great advantage in a succeeding adiabatic absorption of hydrogen chloride and production of hydrochloric acid.

On the other hand, this process of heat recovery and dust collection has the disadvantage that the resulting solution to be sprayed is highly concentrated, heated almost to its boiling point, and dust-laden. The handling of suspensions which contain dust and mineral acids, e.g., hydrochloric or hydrofluoric acids, and are to be sprayed, e.g., under a pressure of 8 bars above atmospheric pressure, gives rise to problems which are almost insoluble even with advanced chemical pumps. As a result, plants which operate satisfactorily in other respects frequently exhibit pump failures, which result in a high expenditure for the maintenance and repair of pumps and often in a shutdown so that the operating costs are increased and the irregular operation results in a lower output of the plant and in a product of lower purity and uniformity not only as regards its chemical analysis but also as regards its physical structure (particle size spectrum, specific surface area etc.), although these properties are critical for metal oxides etc. which are produced in such plants.

Whereas the process has suffered from these drawbacks for decades, they have been tolerated because a remedy was not known.

It is known that aggressive liquids can be handled without contacting moving parts, other than valves, by a blow case (acid egg), which is filled with the liquid to be handled, whereafter the liquid is displaced into a pipeline by compressed air or another displacing gas. Pulsometer plants which in most cases comprise a plurality of time-controlled blow cases operating with a phase displacement in the manner of a pump have not been satisfactory for the above-mentioned process because such plants must usually be resistant at least to hydrogen chloride and often also to humid hydrogen fluoride vapors, e.g., in the processing of pickling liquors which contain nitric and hydrofluoric acids and have been used to pickle stainless steels.

It is an object of the invention to feed the solution or suspension to be treated to the nozzles by means of a compressed gas and a sufficiently large blow case. Another object is to avoid the difficult control and automation problems which arise under the corrosive conditions which exist.

A further object of the invention is to enable an exact measurement of the pressure and rate at which the solution or suspension is fed to the nozzles. To accomplish this object, pressure and volumetric flow rate of the displacing gas are measured and indications of the pressure and feed rate of the solution or suspension are derived from the results of such measurement.

In the normal practice of the process the solution or suspension is fed by a plurality of blow cases which operate with a phase displacement so that a fully continuous, uniform operation is enabled.

The feeding system for carrying out this continuous process comprises one blow case or a plurality of blow cases, which operate with a phase displacement. In accordance with the invention, the displacing gas supply conduits for supplying the displacing gas to respective blow cases are joined by purge gas supply conduits for supplying a purge gas during non-feeding periods so that an ingress of corrosive gases into the pneumatic system is prevented.

According to a further feature, the feeding system comprises controlled venting valves through which the purge gas and the displacing gas which is being displaced by the liquid or sludge can escape during non-feeding periods.

Because a uniform feeding is mostly provided for, the feeding and purge cycle can be controlled more simply by timing means. According to a further feature, the system comprises respective timers for controlling venting valves and for controlling the supply of displacing gas to each blow case.

This system may be provided with preferably adjustable throttles in the purge gas supply conduits and with a control system which causes the venting valve of each blow case to be closed before displacing gas is supplied to the blow case so that the pressure in the blow case can be built up almost to the feeding pressure until the displacing gas is supplied thereto and the short-time pressure drop caused by the change-over is minimized.

It will be desirable to provide valves which in case of a power failure assume a neutral position in which they admit purge gas to all blow cases. In this case corrosive case will not enter the pneumatic section of the system even in case of a power failure.

In a preferred embodiment, the system comprises flow meters for indicating the displacing gas flow rate and, indirectly, the feeding rate of the system.

The timers consist in one embodiment of cam-controlled two-position three-way valves incorporated in the conduit for supplying displacing or control gas and in another embodiment of a three-position five-way valve, which is pneumatically controlled by a pilot valve and controls the supply of purge gas or displacing gas to the blow cases. Said pilot valve consists desirably of a two-position five-way valve, which is incorporated in a control pressure conduit and pneumatically controlled by one of the two-position three-way valves which are cam-controlled in accordance with a timing program.

The advantages of the invention can easily be recognized. A uniform operation is obtained in combination with a high and uniform output of the system, low operating costs, high and uniform purity and constant physical structure of the product. The accurate adjustment of the particle size and structure of the product is also improved by the fact that the pressure at the spray nozzles can be adjusted within a much larger range and can be held much more constant than where pumps are used. Entirely different nozzles may be used and may be operated at inlet pressures differing by orders of magnitude to meet different requirements, e.g., regarding the specific surface area of various materials. This is not possible where pumps are used, which have relatively rigid characteristics and which, in addition, are much more expensive and much more liable to be deranged.

Figure 2:
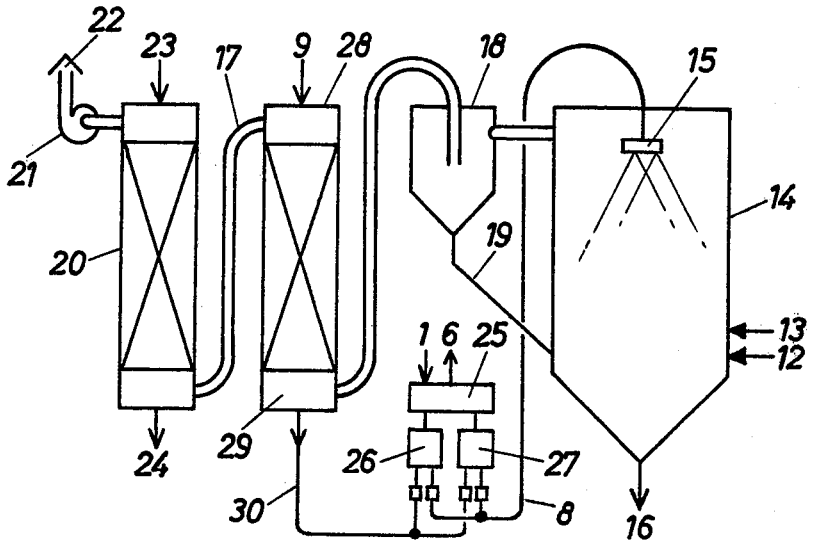
Figure 3:
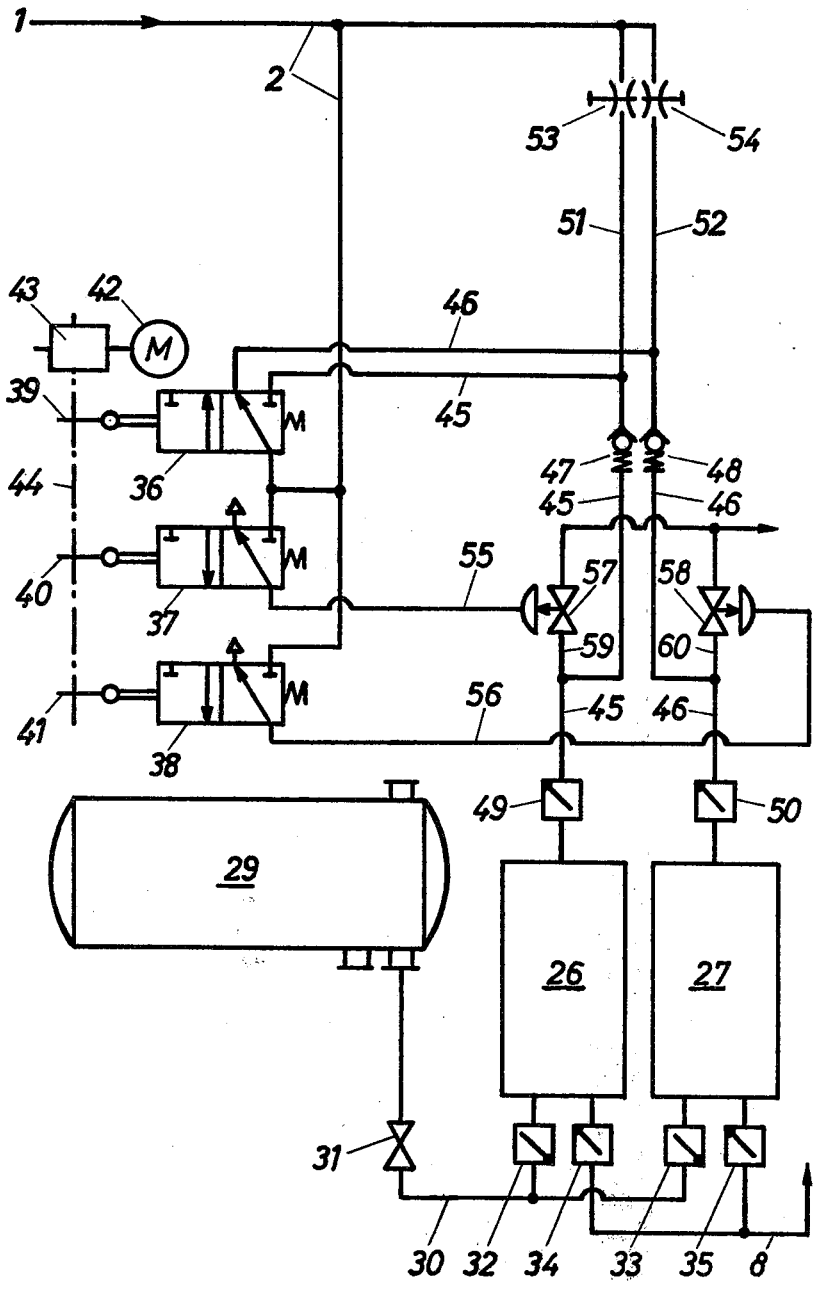
Figure 4:
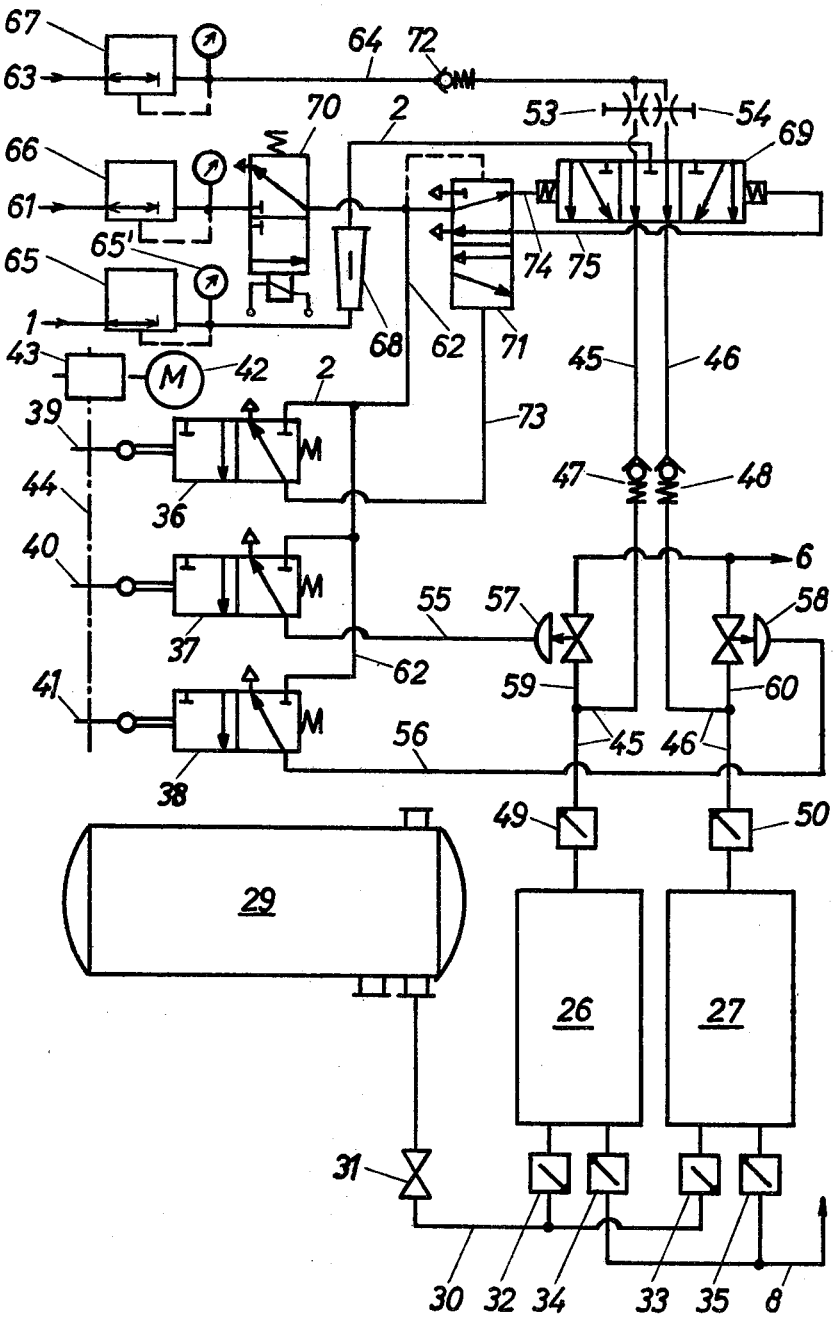
Figure 5:
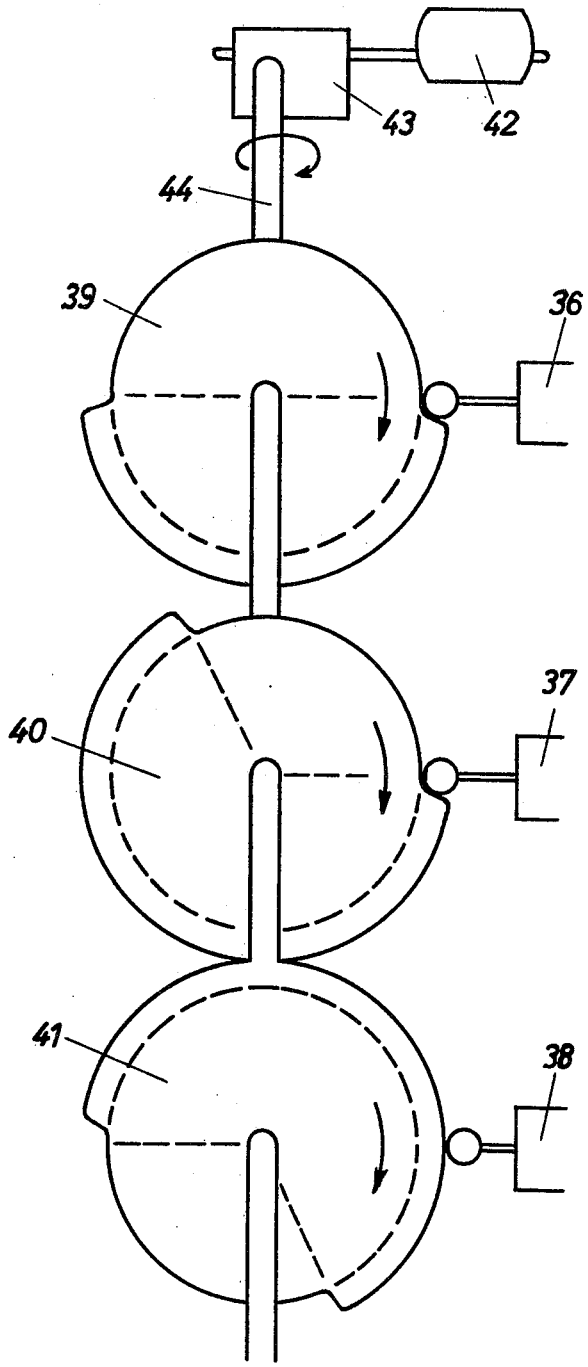

Further details of the invention are apparent by way of example for the drawings, in which FIGS. 1 and 2 are two flow schemes illustrating the present process by way of example, FIGS. 3 and 4 show two embodiments of a feeding plant which can be used in accordance with FIG. 2 for spraying a liquid or slurry, and FIG. 5 is a sketch showing a detail of FIGS. 3 and 4.

In accordance with FIG. 1, a supply line 1 for a displacing gas, such as compressed air or an inert gas, e.g., nitrogen from steel cylinders, is connected to a pipeline 2, in which a pressure-reducing valve 3 provided with a pressure gage 3', flow meter 4, e.g., a Rotameter, and a shut-off valve 5 are incorporated, in this order, and succeeded by a junction to branch pipe, which incorporates a shut-off valve 6. The pipeline 2 is connected to a corrosion-resisting blow case 7 at the uppermost point thereof. A discharge conduit 8 extends from the lowermost point of the vessel 7 and incorporates a junction to a valve-controlled supply conduit 9 for the liquid or slurry to be treated, a shut-off valve 10 and a junction to a valve-controlled water supply conduit 11, in this order. The conduit 8 then rises to the top of an empty furnace 14, which is directly heated, e.g., by the combustion of air from conduit 12 and fuel gas or fuel oil from conduit 13. The conduit 8 depends into the furnace 14 from the top thereof and terminates in a nozzle carrier 15, which is provided with a plurality of spray nozzles depending from its underside. In the present example, the furnace has a downwardly tapering lower portion, which is provided at its lowermost point with means 16 for discharging the condensed reaction product, which consists of a melt or powder. A vapor exhaust conduit 17 extends from the top end of the furnace to a cyclone 18, from which a recycle conduit 19 for condensed particles which have been entrained and collected extends to the furnace. The vapor exhaust conduit 17 extends from the cyclone to the lower end of a packed column 20 and from the top thereof through an exhaust fan 21 into the open to discharge purified exhaust gases into the atmosphere at 22. A scrubbing liquid, such as water 23, is distributed over the packing layer at the top of the column 20 and when arrived at the lower end of the column is withdrawn at 24 together with the constituents which have been scrubbed off.

When it is required, e.g., in the production of $SiO_2$ from chlorosilanes, the blow case 7 is first purged with an inert gas, which is also used as a displacing gas and supplied from conduit 1. For this purging, the valve 6 is closed and the valves 10, 5 and 3 are opened for some time so that the gas flows through the blow case into the furnace.

To start the plant, the valves 3, 5, and 10 are closed, the fan 21 is started, water is fed through conduit 23 to the top of the column 20 and the valve in the water supply conduit 11 is opened to supply water also to the furnace 14. The combustion of fuel from conduit 13 with air from conduit 12 is initiated by an ignition so that the furnace is heated up while the sprayed water evaporates.

To initiate production, the valve 6 is closed, the valve 5 is opened, and the pressure-reducing valve 3 is carefully opened until the required gas pressure is indicated at the associated pressure gage 3'. Then the valve in conduit 11 is closed and the valve 10 is opened so that the liquid or slurry to be heat-treated is supplied to and sprayed into the furnace. Even with agressive fluids which can be measured only with difficulty, the feed rate can easily and exactly be determined from the flow rate of the consumed displacing gas, indicated by the flow meter 4, and the gas pressure, which is read from the pressure gage 3' associated with the valve 3. It is also possible to check whether the nozzles mounted in the nozzle carrier 15 operate satisfactorily or whether a clogging, corrosion etc. gives rise to trouble, which results in an increase or decrease of the gas pressure at a given flow rate.

Within a period of 10ths of a second to seconds, each droplet of the solution or slurry which has been sprayed into the furnace 14 is evaporated, possibly with formation of crystals, and only subsequently heated to a temperature which is greatly above the boiling point of the liquid which has been evaporated. Some substances, such as silica slurries, are merely dried. In the treatment of other substances, such as precipitated chalk, the carbonate may be only dried or may also be decomposed to form caustic lime, depending on temperature. The treatment is often applied to solutions of salts. Common salt is merely dried. Zinc chloride is dried and then melted and is withdrawn as a liquid. Magnesium chloride is first crystallized as its hexahydrate, from which the water of crystallization is then removed in successive steps. In a subsequent roasting step, the chloride is hydrolized in water vapor to form magnesia. The decomposition of ferrous chloride to iron oxide is accompanied by an oxidation of divalent to trivalent iron with consumption of oxygen, which must be accounted for in the determination of the rate at which oxygen is to be supplied for the combustion of the fuel. In any case, a condensed product is obtained, which is in most cases a powder and a major portion of which subsides to the bottom immediately. Another portion of the product is collected in the cyclone 18 and is fed through a downcomer 19 also to the bottom of the furnace 14, from which the product is discharged at 16. A remainder of the product is entrained by the vapors flowing through conduit 17 into the scrubbing column 20 and is scrubbed off there so that perfectly pure exhaust gases are exhausted from the system at 22 through the exhaust fan 24. Particularly in the treatment of hydrolyzable halides, the vapors initially contain gaseous hydrogen halide, which dissolves in the water fed through conduit 23 to the column 20 so that a subazeotropic hydrohalic acid can be recovered and discharged through conduit 24 as a second product. It is preferable to change over to the supply of water before all liquid or slurry to be processed which is contained in the blow case 7 has been consumed. Alternatively, the pressure gage 3' may be constantly watched; in this case the valves 3, 6, and 10 are closed when the pressure gage 3' indicates a rapid pressure drop. The valve 11 is subsequently opened. Otherwise, the furnace and particularly the nozzle carrier 15 are superheated and damaged. After a supply of water for some time, the supply conduits 13 and 12 for fuel and air are closed and the nozzle carrier 15 and the pipe rising therefrom are withdrawn from the furnace 14 and finally the fan 21 is shut down as well as the supply of water through conduits 11 and 23. Before the next run the blow case must be refilled as described hereinbefore and may previously be cleaned, if required. This modification of the process may be used for treating solutions or slurries in batches which are not very large so that the system must be shut down and cleaned in any case before the treatment of another raw material.

On the other hand, the process represented by the flow scheme of FIG. 2 is suitable for a continuous thermal processing of liquids or suspensions at a high rate and with a heat exchange between the vapors and the fluid to be fed in an additional heat exchanger, in which dust is collected from the vapors, heat is recovered, and a liquid is obtained which is highly concentrated, at a highly elevated temperature, and laden with dust. This liquid imposes high requirements on the plant for feeding the liquid to the nozzle carrier 15. This problem is solved satisfactorily by a system according to the invention comprising two blow cases.

The process differs in the following respects from the embodiment shown in FIG. 1: The discharge conduit 8 is preceeded by a feeding system which comprises two blow cases 26, 27, which operate with a phase displacement under the control of a control system 25. The liquid or suspension to be processed is supplied from conduit 9 to a direct-contact heat exchanger, which consists in this case of a packed column 28 and has a gas flow path connected in series in the vapor conduit 17 between the cyclone 18 and the column 20. In this heat exchanger, the liquid or suspension is heated by the sensible heat of the exhaust gases from the furnace and is thus concentrated by evaporation and is also laden with dust and subsequently collected in a supply vessel 29, which is formed by the lower portion of the column 28. From the supply vessel 29, a conduit 30 leads to the feeding system, which comprises blow cases 26 and 27, which can be filled in that they are connected to the conduit 30. To initiate and terminate the operation, the water is not directly supplied to the discharge conduit 8 but instead of the solution or suspension 9 is supplied to the column 28. To avoid clogging or other troubles, care must be taken that the solution or suspension 9 is not evaporated in the heat exchanger 28 to a concentration which exceeds an upper limit determined by the solubilities of the salts and/or the behavior of the sludges. For instance, rinsing water may also be processed and may be used at the same time to ensure that the liquid or slurry from conduit 9 is fed at a concentration below the upper limit.

Whereas the feeding system is indicated in FIG. 2 only by the blow cases 26, 27 and the control system 25, an illustrative embodiment of such system is shown more in detail in FIG. 3. A supply vessel 29 for the solution or slurry to be sprayed is equivalent to the supply vessel 29 consisting of the lower portion of the column 28 in FIG. 2. The supply vessel 29 is connected by a conduit 30, a shut-off valve 31, and branch conduits containing respective check valves 32, 33 to respective blow cases 26, 27, toward which the check valves 32, 33 open. Two additional check valves 34, 35 are connected to the bottom of the respective blow cases and open in the opposite direction and are connected by respective branch conduits to the discharge conduit 8, which in accordance with FIG. 2 leads to the nozzle carrier 15 in the spray furnace 14. The displacing gas is supplied from conduit 1 to a pressure conduit 2, to which three spring-loaded two-position three-way valves 36, 37, 38 are connected in parallel. These valves 36, 37, 38 are cyclically time-controlled by respective camwheels 39, 40, 41 on a shaft 44, which is driven by a motor 42 and a speed-reducing transmission 43. On its other side, the valve 36 is connected to the top of the respective blow cases 26, 27 by two parallel pressure conduits 45, 46, which incorporate respective check valves 47, 48 opening in the direction away from the valve 36, and respective ball float valves 49, 50, which open in the same direction but are only hydraulically operable. The pressure conduits 45, 46 are also connected by respective branch conduits 51, 52 to respective throttles 53, 54, which communicate with the pressure conduit 2. From the time-controlled two-position three-way valves 37, 38, respective conduits 55 and 56 lead to respective pneumatically controlled venting valves 57 and 58, which open in the absence of a control pressure and are incorporated in respective venting conduits 59 and 60, which branch from respective pressure conduits 45, 46 between the valves 47, 49 and 48, 50, respectively, and join the venting manifold 6, which leads, e.g., to the bottom of a column in which the escaping gas can be scrubbed before being exhausted into the atmosphere. The parts 36 to 44 may be used also in the embodiment of FIG. 5 and their description is also applicable thereto. In the following description of the mode of operation, reference is made to FIG. 3 and the understanding of the description will be facilitated if the reader inspects also FIG. 5. It is assumed that one complete revolution of shaft 44 takes, e.g., 1 minute, and the two-position three-way valve 36 is spring-urged to the left to its neutral position for 30 minutes and the two-position three-way valve 37 is spring-urged to the left to its neutral position for 20 minutes from the instant represented in FIG. 5, whereas the two-position three-way valves 36, 37 are urged by the camwheels 39, 40 to the right against the spring pressure for the remainder of the time until the end of the 60th second. The two-position three-way valve 38 is urged to the right for 30 seconds by the camwheel 41, which subsequently permits the spring to urge the valve 38 to the left to its neutral position for 20 seconds, whereafter the camwheel urges the valve 38 back to the right from the 51st second. This timing selected by way of example results in the following. The conduits 46, 56 communicate directly with the pressure conduit 2 and the venting valve 58 is pneumatically closed so that the liquid or slurry contained in the blow case 27 is discharged into the discharge conduit 8 through the open check valve 35 whereas the check valve 33 is closed. As the two-position three-way valve 37 in its initial neutral position relieves the control pressure conduit 55, the pneumatically actuated valve 57 is also in its unactuated, open position so that the blow case 26 communicates through the open conduit 59 directly with the venting conduit 6 and is thus relieved from air pressure so that, when the valve 31 has been opened by hand, liquid or slurry can flow from the supply vessel 29 into the blow case 26 through the check valve 32, which opens in this direction. The valve 49 provided with a ball float is not closed by the vented gas but is closed only, e.g., by a pressure surge of the liquid in the conduit 45 at the end of the filling operation. On the other hand, even the gas which is vented from the blow case 26 as the latter is filled may have a highly corrosive action, e.g., when hot fluids which contain hydrochloric acid are to be fed and the vented gas contains hydrogen chloride gas in equilibrium with the fluid to be fed. Nevertheless, agressive gases and mists cannot enter the delicate pneumatic control section of the feeding system because the conduit 45 is constantly purged as far as to the junction to the venting conduit 59 by a displacing gas, which flows constantly at a low rate through the by-pass conduit 51 and the throttle 53, whereas the conduit 45 is closed by the two-position three-way valve 36, and which escapes into the venting manifold 6 together with the gases vented from the blow case.

Twenty seconds later, when the filling of the blow case 26 has reliably been completed, the camwheel 40 urges the two-position three-way valve 37 to the right so that the pressure conduit 2 is connected to the control pressure conduit 55 and the pneumatically operable valve 57 is closed to terminate the venting from the blow case 26. Displacing gas still flows at a low rate through the by-pass conduit 51 and the throttle 53 and gradually increases the pressure in the blow case 26 so that the check valve 32 closes and the required feeding pressure is almost reached after a few seconds.

Further 10 seconds later the camwheel 39 urges the two-position three-way valve 36 to the right and the camwheel 41 permits the two-position three-way valve 38 to be spring-urged to the left to its neutral position so that the conduit 56 is vented and the pneumatically operable valve 58 falls to its neutral, open position, the gas cushion in the blow case 27 is pressure-relieved through conduits 60 and 6 and, as a result, the check valve 35 is closed, the discharge from the blow case 27 is terminated, the check valve 33 is opened and the filling of the blow case 27 from the supply vessel 29 through conduit 30 is initiated. Because the two-position three-way valve 36 has been shifted, displacing gas from the pressure conduit 2 now flows through the conduit 46 rather than the conduit 45 so that the blow case 26 now discharges at the full rate through the open check valve 34 into the discharge conduit 8.

After additional 20 seconds, i.e., after a total of 50 seconds, the camwheel 41 again urges the two-position three-way valve 38 to the right so that pressure is applied to the conduit 56 to close the valve 58 and gas flowing through the by-pass conduit 52 and the throttle 54 causes the pressure in the gas space over the liquid or slurry in the blow case 27 to rise slowly to the feeding pressure, as has been described for the blow case 26. Ten seconds later the shaft 44 has completed a revolution, the camwheels 39, 40 permit the two-position three-way valves 36, 37 to be spring-urged to the left to their neutral position and the next cycle begins, as has been described hereinbefore. It will be understood that the intervals described here are selected only by way of example and must be selected in practice in view of the sizes of the blow cases and of the pipelines and of the discharge rates from the nozzles in the nozzle carrier 15 (FIG. 2) etc.

FIG. 4 shows by way of example how the pneumatic control system of FIG. 3 may be expanded. With the additional expenditure, the discharge rate of the system can be derived from the flow rate of the displacing gas. This is not possible with the simpler arrangement because in the latter the displacing gas is used also to purge the conduits and to perform pneumatic control actions. The expanded system comprises also means for an automatic shutdown in case of a power failure.

The arrangement of FIG. 4 differs from that of FIG. 3 in the following features: The system is not only supplied with displacing gas from conduit 1 through supply conduit 2 but is separately fed with control gas from a conduit 61 through a supply conduit 62 and with purge gas from a conduit 63 through a supply conduit 64. All these gases may consist of compressed air from the same source, although this is not essential. Care must be taken that in case of a power failure the supply of purge gas 63 can be continued for some time from a pressure accumulator or from a compressor which is energized from an emergency power supply. Each of the three gases from conduits 1, 61, and 63 is reduced to a constant supply pressure, e.g., of 8, 4 and 6 bars, respectively, above atmospheric pressure, by a separate manostat 65, 66 or 67. Behind the manostat 65, the pressure conduit 2 contains a gas flow meter 68, e.g., a Rotameter, and the discharge rate of the pressure-fed liquid or slurry can be derived from the indication of the Rotameter 68 in conjunction with the pressure indicated by the manometer 65' which is associated with the manostat 65. The pressure conduit 2 terminates in a pneumatically controlled three-position five-way valve 69. The control gas for performing the pneumatic control actions is supplied from conduit 61 to supply conduit 62 and in the latter is pressure-reduced by the manostat 66 in most cases to the conventional control pressure of 4 bars above atmospheric pressure. The control gas then flows freely through a two-position three-way valve 70 when the normal supply voltage is applied thereto. In case of a power failure, the valve 70 is spring-urged to its neutral position to block the inflow of control gas and to vent the succeeding conduit portion. Behind the valve 70, the control pressure conduit 62 is connected to four parallel branch conduits leading respectively to two-position three-way valves 36 to 38 and to a pilot valve 71, which consists of a two-position three-way valve and serves to control the valve 69. Coming from conduit 63, the purge gas is first pressure-reduced in the supply conduit 64 by the manostat 67, e.g., to 6 bars above atmospheric pressure and then flows through a check valve 72, which opens in this direction, and finally branches to two parallel throttles 53, 54, which are connected to the three-position five-way valve 69. A control conduit 73 is connected between the two-position three-way valves 36 and 71 and causes the latter to be controlled by the former. The two-position three-way valve 71 controls the three-position five-way valve 69 and for this purpose is connected thereto by two control pressure conduits 74, 75.

Whereas the blow cases are vented in the manner described hereinbefore, the displacing and purge gases from conduits 61 and 63 are controlled by the two-position three-way valve 36 in a different manner. In successive intervals of 30 seconds, the valve 69 applies control pressure to the conduit 73 and vents the latter in alternation so that the pilot valve 71 is lifted and under the pressure of the so-called gas spring (constant supply of control gas to the upper end of the valve, indicated by dotted line) is urged down to its neutral position in alternation with the same timing. In its neutral position, the two-position three-way valve 71 applies control pressure to the conduit 74 and pressure-relieves the conduit 75. When the pilot valve 71 is in its upper position, the conduit 74 is pressure-relieved and the conduit 75 is under pressure. As a result, the conduits 74, 75 apply control pulses to the three-position five-way valve 69 so that the latter is reciprocated between its left-hand and right-hand positions after intervals of 30 seconds. When the two-position three-way valve 36 is in its neutral position, it causes the pilot valve 71 to remain in its neutral position and the three-position five-way valve 69 to remain in its right-hand position so that the conduit 45 connected to the three-position five-way valve 69 communicates through the throttle 53 with the purge gas supply conduit 64 and the conduit 46 also connected to the three-position five-way valve 69 communicates with the pressure conduit 2. Now the blow case 27 is discharging and the blow case 26 is being filled. On the other hand, when the camwheel 39 urges the two-position three-way valve 36 to the right, the pilot valve 71 is lifted by the pressure in the conduit 73 and the two-position three-way valve 69 is urged to the left by the control pressure in conduit 75 so that displacing gas pressure is applied to conduit 45 and throttled purge gas pressure is applied to conduit 46. As a result, the blow case 26 is now discharging and the blow case 27 is being filled.

In case of a power failure the two-position three-way valve 70 is spring-urged to its zero position and thus blocks the flow of control gas from conduit 61 to conduit 62 and causes the latter to be vented. Regardless of the position of the two-position three-way valve 71, this action causes both conduits 74 and 75 to be pressure-relieved so that the three-position five-way valve 69 is urged by its two end springs to its intermediate position, which is shown on the drawing. As a result, the two conduits 45, 46 communicate through the throttles 53, 54 with the purge gas supply conduit 64 and the flow of purge gas prevents an ingress of corrosive vapors and mists into the pneumatic system. At the same time, the discharge through conduit 8 is interrupted because regardless of the position of the two-position three-way valves the conduits 55, 56 are pressure-relieved and the valves 57, 58 are moved to their neutral positions to permit both blow cases to be vented. The result is not only that in case of a power failure a further discharge, e.g., under a lower pressure, is prevented so that the furnace cannot be flooded but also that aggressive vapors cannot result in a destructive corrosion in the control system.

What is claimed is:

1. A system for feeding solutions and suspensions to nozzles for spraying the solution or suspension into a heated furnace chamber, comprising at least one blow case for feeding the solution or suspension to the nozzles under the action of a compressed displacing gas and means for measuring the volumetric flow rate and instantaneous pressure of the displacing gas, a plurality of blow cases operating with a phase displacement, displacing gas supply conduits for supplying compressed displacing gas to respective blow cases, and purge gas supply conduits which join respective displacing gas supply conduits and serve to supply a purge gas during non-feeding periods to prevent an ingress of corrosive gases into the pneumatic system.

2. A system as set forth in claim 1, characterized in that each blow case has a venting valve connected thereto, which is controlled to be open when the blow case is being filled during a non-feeding period so that the displacing gas which is being displaced by the liquid or suspension as well as the purge gas can then escape through said venting valve, and that control means are provided which comprise respective timers for controlling the venting valves and the supply of displacing gas to each blow case.

3. A system as set forth in claim 1, characterized by preferably adjustable throttles in the purge gas supply conduits and by automatically controlled venting valves which are closed before the pressure of the displacing gas is applied to the associated blow case.

4. A system as set forth in claim 1, which comprises means for supplying purge gas to all blow cases through the respective displacing gas supply conduits in response to a power failure.

5. A system as set forth in claim 1, which comprises timers consisting of cam-controlled two-position three-way valves incorporated in the displacing gas supply conduit.

6. A system as set forth in claim 1, characterized in that the displacing gas supply conduit incorporates a three-position five-way valve, which is pneumatically controlled by a pilot valve and serves to supply the blow cases with purge gas and displacing gas in alternation.

7. A system as set forth in claim 1, in which a control pressure conduit incorporates a pilot valve, which consists of a two-position three-way valve, which is pneumatically controlled by a cam-controlled two-position three-way valve.

* * * * *